United States Patent [19]

Akkerman

[11] Patent Number: 4,542,792

[45] Date of Patent: Sep. 24, 1985

[54] METHOD AND REMOVABLE AUXILIARY APPARATUS FOR PERMANENTLY LOCKING OPEN A WELL FLOW CONTROL DEVICE

[75] Inventor: Neil H. Akkerman, Kingwood, Tex.

[73] Assignee: Baker Oil Tools, Inc., Orange, Calif.

[21] Appl. No.: 582,172

[22] Filed: Feb. 21, 1984 (Under 37 CFR 1.47)

Related U.S. Application Data

[63] Continuation of Ser. No. 259,784, May 1, 1981, abandoned.

[51] Int. Cl.[4] ..... E21B 23/04; E21B 34/06

[52] U.S. Cl. ..... 166/374; 166/72; 166/319; 166/323; 166/334

[58] Field of Search ..... 166/374, 373, 319-325, 166/317, 72, 330-334

[56] References Cited

U.S. PATENT DOCUMENTS

| | | | |
|---|---|---|---|
| 3,744,564 | 7/1973 | Mott | 166/322 |
| 3,762,471 | 10/1973 | Mott | 166/322 |
| 3,763,932 | 10/1973 | Dinning | 166/322 |
| 3,763,933 | 10/1973 | Mott | 166/322 |
| 3,896,876 | 7/1975 | Crowe | 166/72 |

*Primary Examiner*—James A. Leppink

*Assistant Examiner*—Hoang C. Dang

*Attorney, Agent, or Firm*—Norvell & Associates

[57] ABSTRACT

A method and removable auxiliary lock open apparatus are provided for permanently locking open a flow control device, mounted in a conduit in a subterranean well, having a valve head reciprocally movable between open and closed positions relative to a valve seat, and a driving means mechanism which includes a locking sleeve for manipulating the flow control device into the open and closed positions. The removable apparatus includes a locking wedge, carried by and disengageable from a locking wedge carrier, and piston member which are extendable relative to the locking wedge carrier for forcing the locking wedge from the locking wedge carrier into a lock urging position on the sleeve of the flow control device. When the locking wedge has been forced by the piston members into its locking position in the flow control device and is disengaged from the locking wedge carrier, the auxiliary apparatus is removed from the safety valve, leaving the locking wedge in the flow control valve to retain the latter permanently in its open position, with the flow of fluids therethrough unhindered by the apparatus employed to place the flow control device in its locked open position.

18 Claims, 9 Drawing Figures

METHOD AND REMOVABLE AUXILIARY APPARATUS FOR PERMANENTLY LOCKING OPEN A WELL FLOW CONTROL DEVICE

CROSS-REFERENCE TO RELATED APLICATION

This application is a continuation application of my co-pending application Ser. No. 259,784, filed May 1, 1981, now abandoned entitled "A Method And Removable Auxiliary Apparatus For Permanently Locking Open A Well Flow Control Device".

BACKGROUND OF THE INVENTION

1. Field of the Invention

The invention relates to a method and apparatus for permanently locking open a well flow control device, such as a safety valve, which is mounted on a tubular conduit in a subterranean well.

2. Description of the Prior Art

In order to control the flow of hydrocarbons from a production zone or zones within a subterranean well through one or more production conduits, it is desirable and in the United States mandatory by governmental regulations, for offshore wells to provide each production conduit with a downhole safety valve, which is reciprocatingly movable between an open and closed position by a variation in the hydraulic control fluid pressure which is in communication with the valve structure through a control line conduit extending from the top of the well, such as from a control panel on the platform, or the like.

Occasionally, a well flow control device will lose its closing or fluid tight integrity, for example, as a result of debris within the fluid being transmitted into the flow control device at the top of the well and becoming entrapped between sensitive working components of the device, or as a result of the valve being slammed closed upon its valve seat during testing procedures. Therefore, it is necessary for such a well flow control device to include a means for permanently placing the well flow control device in a "locked open" position, so that thereafter, an auxiliary flow control device, such as a wire line manipulated safety valve device, can be emplaced within the production conduit.

SUMMARY OF THE INVENTION

The present invention provides an auxiliary permanent lock open assembly for utilization within such a well flow control device, which can be removed after the flow control device is permanently locked therewith in an open position, thereby leaving unhindered the flow of fluid therethrough. This invention also provides such an assembly which can be activated directly by pressure within the moving conduit and does not rely on the hydraulic control system of the flow control device used to manipulate it between open and closed positions.

The flow control device employed in the method of this invention has a valve head which is reciprocatingly movable between an open and closed position relative to a valve seat, and drive means, which includes a locking sleeve, manipulates the flow control device into its open and closed positions. The removable auxiliary locking apparatus of this invention comprises a locking wedge, carried by and disengageable from a locking wedge carrier means, and piston members which can be extended relative to the locking wedge carrier for forcing the locking wedge from the locking wedge carrier into a lock urging position on the locking sleeve of the flow control device. In the method of this invention, the auxiliary locking apparatus is lowered into the well in locking position relative to the flow control valve, the latter is urged into its open position if not already in that position, by exerting a hydraulic pressure on the locking apparatus from the surface down the production tubing and rotating the ball valve to its open position with the lower end of the auxiliary locking apparatus. The locking wedge is urged into a gap between the lock open sleeve and the top sub of the well flow control device. The locking wedge prevents movement of the locking sleeve from the lock open position so that the flow control device is left with the locking wedge therein and in a permanently open position.

In a preferred embodiment, the permanent lock open assembly of the present invention includes a static seal which is carried within a smooth seal bore area which is located on the interior wall of the well flow control housing. The seal cannot travel along the receiving bore during manipulation of the permanent lock open assembly, thereby providing a more efficient means of maintaining control of the well fluid when the lock open assembly is positioned within the well flow control device. Further, the seal is not affected by a corroded or eroded seal bores.

DESCRIPTION OF THE PREFERRED EMBODIMENTS

Figure 1A:
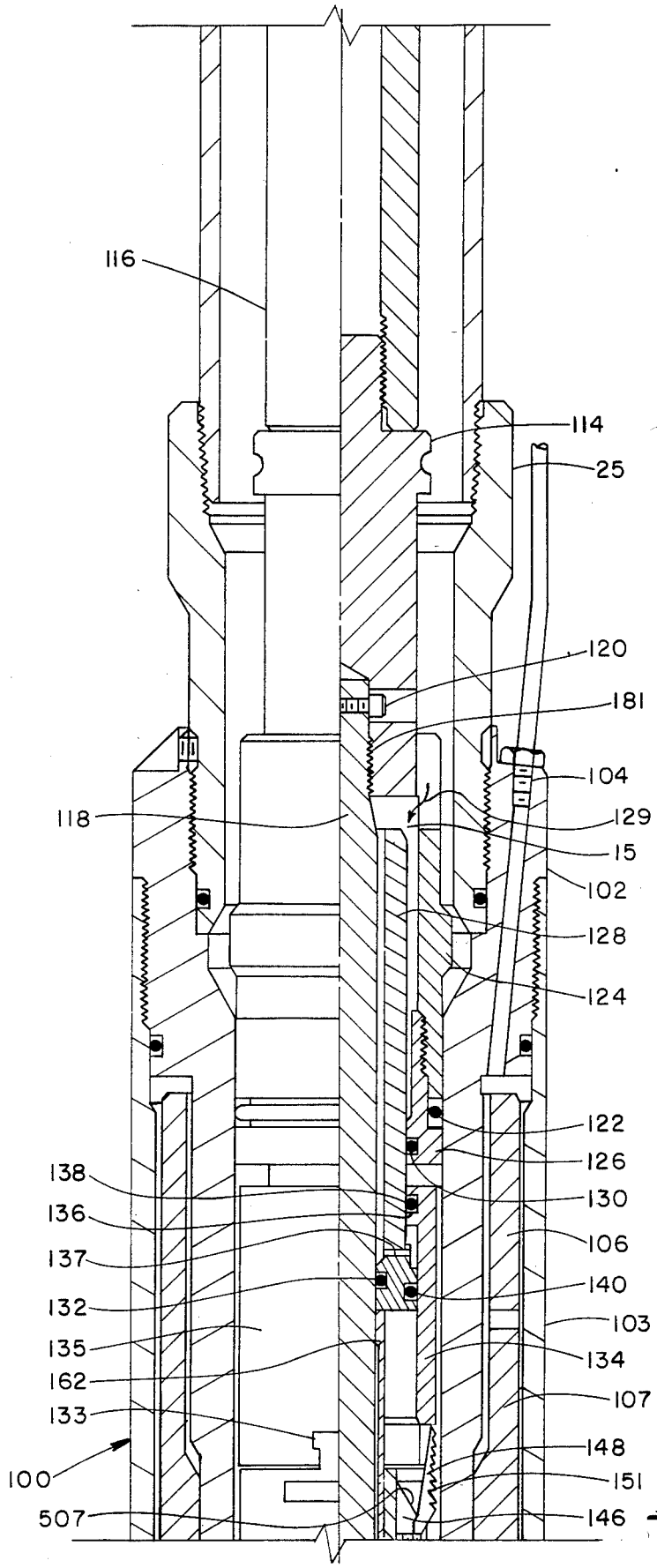
FIGS. 1A, 1B, and 1C are each longitudinally extending partial sectional views of successive portions of a well flow control device shown in a closed position, with the removable auxiliary locking apparatus of the present invention inserted therein on a wire line manipulated running tool, before tubing pressure has been applied thereto.

The present invention, as shown in FIGS. 1A through 2C, is directed to a method and apparatus for permanently locking, in an open position, a flow control assembly which is typically a safety valve mounted in a conduit of a subterranean well. It is well known in the art that safety valves are commonly used in well conduits. These valves may be of the ball type or flapper type. In describing the invention, its use in conjunction with such ball type valves will be described.

It is also well known that safety valves are reciprocatingly movable between open and closed positions by use of hydraulic fluid controlled by a control panel connected to the safety valve. The safety valve 100 shown in FIGS. 1A through 2C includes a top sub 102 which has a hydraulic control line 104 connected thereto. A lock open piston 106 is received within a space defined by the top sub 102 and the housing wall 103 of the conduit. The lock open piston 106 extends from said space and into the main portion of the conduit. An O-ring seal 105 prevents fluid leakage between the lock open piston 106 and the wall of the top sub 102 into the main body of the well conduit.

Directly below the lock open piston 106 is positioned a lock open piston extension member 206 which acts in concert with lock open piston 106. Further, the lock open piston extension member is secured to an extension 208 by means of threads 210. The extension 208 includes threads 212 at the bottom portion thereof which serve to interconnect the extension 208 with a ball valve control mechanism 110 which operates to rotate the ball valve 112 to its open position.

Positioned adjacent to the ball valve control mechanism 110 is a ball valve lock open sleeve 113 which operates to lock the valve in the open position once it has been opened by the ball valve control mechanism 110. The spring 108 surrounds the extension 208 and is biased so as to urge the lock open piston 106 in the upward direction for normally maintaining the ball valve 112 in the closed condition.

When it is desired to open the ball valve 112, hydraulic pressure is provided through the hydraulic control line 104 so that the lock open piston 106 is urged downward against the lock open piston extension member 206 which compresses the spring 108 and urges the extension 208 in the downward direction. Thus, the ball valve control mechanism 110 rotates the ball valve 112 to its open position and the ball valve lock open sleeve 113 locks the valve open.

To close the ball valve 112, the hydraulic pressure through the hydraulic control line 104 is relieved, and the spring 108 forces the lock open piston 106 back to its original position between the top sub 102 wall and the housing wall 103. The operation of the safety valve which employs the lock open apparatus of the present invention is described in more detail in commonly assigned application Ser. No. 168,887, which was filed on July 14, 1980, and entitled "Method And Apparatus For Permanently Locking Open A Well Flow Control Device".

The lock open apparatus of the present invention is a removable auxiliary device which is secured to a running tool 114 which is inserted onto a member 116 extending to a control conduit, such as a wire line, and run into the well. The removable auxiliary device is used for implanting a locking wedge in the safety valve for permanently locking the safety valve in the open position so that the auxiliary tool can then be removed without removing the locking wedge.

An axially aligned cylindrically shaped solid mandrel 118 is secured at threads 181 to the running tool 114, as shown in FIG. 1A. The two are then held together by a locking screw 120 which is inserted through an opening in the running tool 114 into a threaded receiving bore in the mandrel 118. The running tool 114 has a cylindrically shaped coupling 124 mounted and/or secured thereto and an O-ring 122 surrounds the auxiliary tool near the lower portion thereof for preventing fluid from leaking between the inner surface of the top sub 102, the cylindrically shaped coupling 124, and a cylindrically shaped short nipple 126 which is secrued to the end of the cylindrically shaped coupling 124, both of which fit within the inner diameter portion of the top sub 102.

A cylindrically shaped annular main piston 128 is located around the mandrel 118, on the inside of short nipple 126 and the cylindrically shaped coupling 124, and has O-ring 130 and 132 positioned in contact with each surface of the main piston 128 for preventing pressurized fluid leakage along either surface of the main piston 128. The pressure chamber 15 for the main piston 128 is defined as the surface area of said piston which is located between the cylindrically shaped coupling 124 and the mandrel 118. In operation, pressurized fluid is forced into the pressure chamber 15 for causing the piston 128 to move, as shown by the arrow 129 in FIG. 1A.

The main piston 128 has an axially aligned linear wedge piston 134 which is carried thereon. The top end 136 of the wedge piston 134 includes a recessed portion having an O-ring 138 located therein. Further, the top end 136 of the wedge piston 134 is carried above the bottom portion of the main piston 128 with the main body of the wedge piston 134 resting on the main piston 128. The wedge piston 134 is supported within an axially extending annular recess which has been cut out in a cylinder 135 which surrounds the main piston 128.

There is a locking wedge 148 which has wickers 151 on one side thereof and is secured to a wedge carrying cap 146 by means of a plurality of shear screws 150. The locking wedge 148 is in alignment with the wedge piston 134.

Referring again to the wedge piston 134, the O-ring seal 138 is used for preventing fluid leakage between the surface of the wedge piston top end 136 and the main piston 128. There is a small radially extending aperture 137 extending through the main piston 128 directly under the top end 136 of the wedge piston 134 for permitting fluid under pressure to flow into the area underneath the wedge piston 134 between the O-ring seals 138 and 140.

A collet expanding piston 162 is positioned in axial alignment with the main piston 128. A portion of the collet expanding piston 162 is located between a wedge carrier slide 142, to which the locking wedge carrying cap 146 is secured, and the mandrel 118.

Figure 2A:
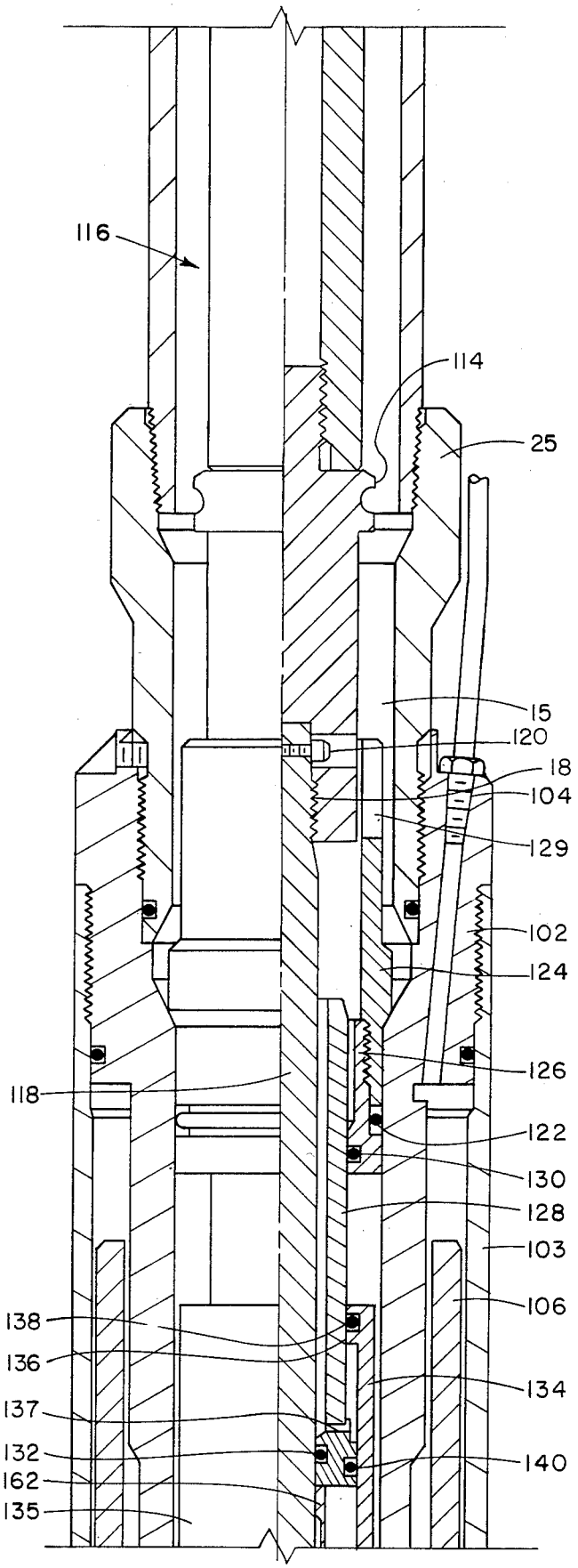
FIGS. 2A, 2B, and 2C are also longitudinally extending partial sectional views of the well flow control device, similar to the portions shown in FIGS. 1A through 1C, respectively, and illustrating the well flow control device in the permanently locked open position subsequent to the application of tubing pressure to the removable auxiliary locking apparatus.
Figure 3:
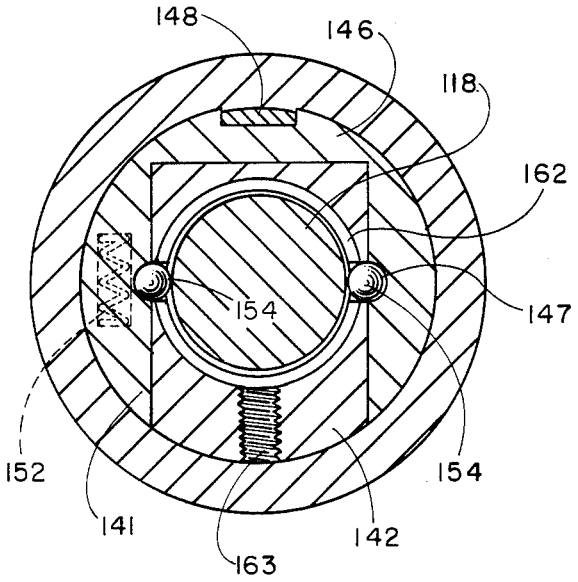
FIG. 3 is a cross-sectional view, taken along lines 3—3 of FIG. 1B, which illustrates the locking wedge of the removable auxiliary locking apparatus in a non-locking position.
Figure 4:
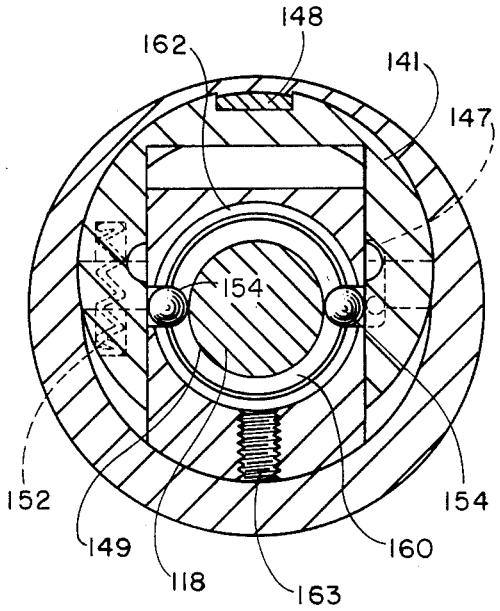
FIG. 4 is a cross-sectional view, taken along lines 4—4 of FIG. 2B, which shows the locking wedge just prior to being moved into the final wedge-locking position.
Figure 5:
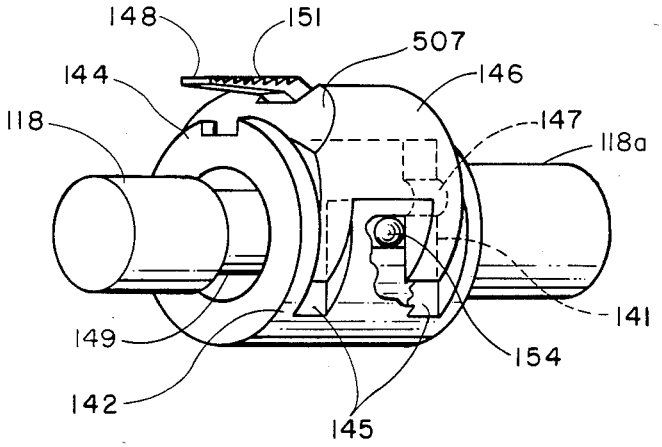
FIG. 5 is a perspective view of the wedge supporting assembly of the device of the present invention, shown in the final locking position, without showing the valve housing.

Referring now to FIGS. 3, 4 and 5, it is clear that the wedge carrying cap 146 is secured to the wedge carrier slide 142 by means of ball bearings 154 which are received in co-extending grooves of the wedge carrier slide 142 and the mandrel 118. The wedge carrier slide 142 is circular in shape and has an outer diameter which is substantially the same as that of the sleeve 135, and is secured to the sleeve 135 at dove-tail slots 133, as shown in FIGS. 1A and 2A.

Figure 1B:
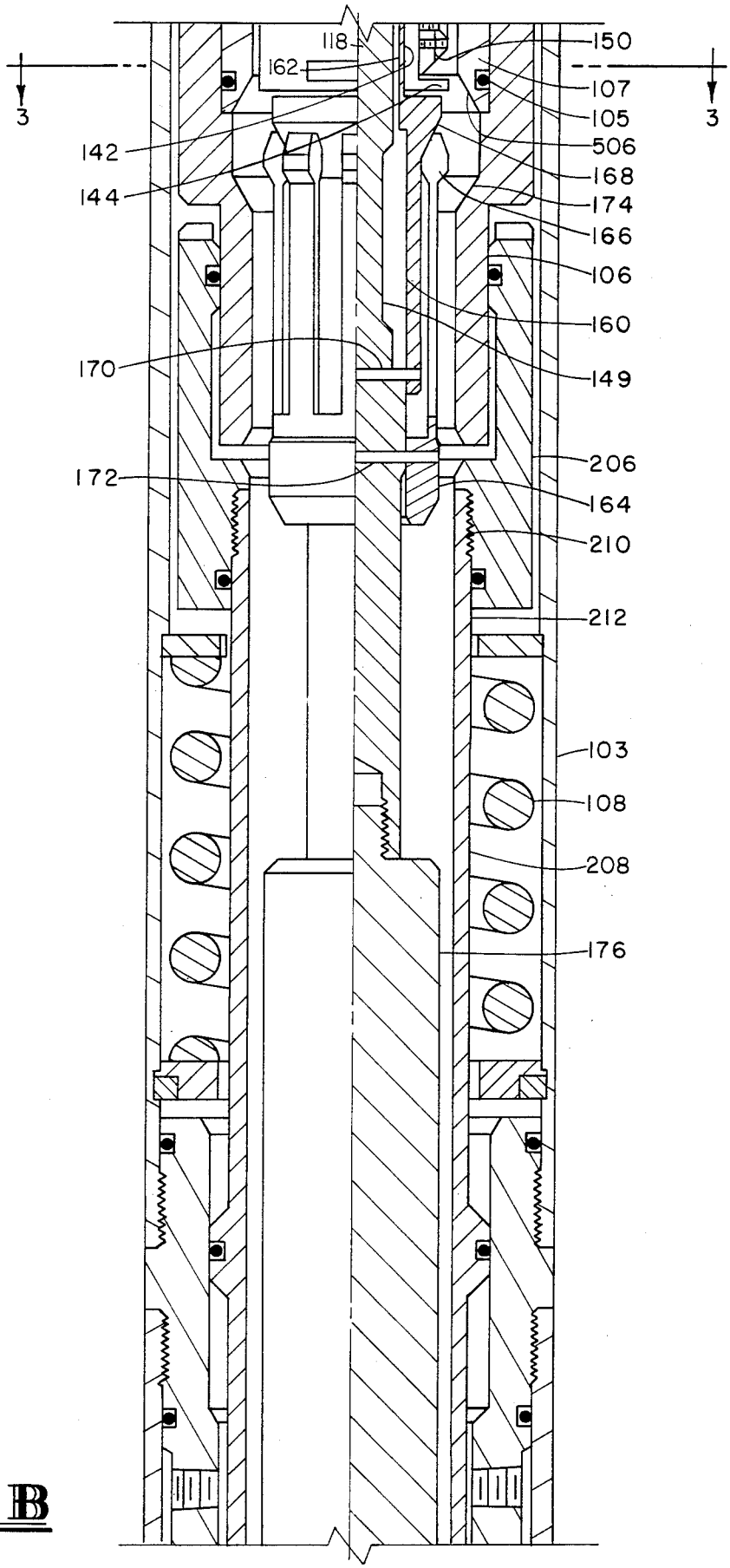

Further, as shown in FIGS. 3 through 5, the wedge carrying cap 146 has downwardly extending spaced apart legs 141 and 143 which are received in slots 145 of the wedge carrier slide 142. The rearwardly or downwardly located legs 141 of the wedge carrying cap 146 have oppositely disposed grooves 147. The collet expanding piston 162 includes apertures which are located opposite the grooves 147 so that ball bearings 154 can be held simultaneously within the grooves 147 and adjacent the larger diameter surface **118*a* the mandrel 118. As a result, the wedge carrying cap 146 will be retained in the retracted position as shown in FIGS. 1A, 1B and FIG. 3. The locking wedge 148 is secured to the wedge carrying cap 146 by shear screws 150, as shown in FIGS. 1A and 1B, with the wedge carrying cap 146 urged outwardly by a force which is exerted thereon by four springs 152 which are held compressed when the ball bearings 154** are located in the coextensive grooves.

There is a bearing recess 160 which is cut annularly into the mandrel surface for defining a smaller mandrel diameter section 149. Therefore, the wedge carrying cap 146 can be released for movement in the radial direction by moving the wedge carrier slide 142 axially downward so as to allow the ball bearings 154 to fall into the bearing recess 160 and mandrel smaller diameter section 149. In the auxiliary locking device, the wedge carrier slide 142 is locked to the collet expanding piston 162 by means of shear pin 163, said locking functioning to restrain the movement of the wedge piston 134 until a specified pressure has been built up for shearing the pin 163. The operation of the wedge carrier slide 142 with respect to the wedge piston 134 will be explained later.

Below the wedge carrier slide 142 is located a collet 164 which has axially disposed fingers 166 normally biased in a radially inwardly direction. The collet 164 surrounds the mandrel 118. The collet expanding piston 162 includes a radially projecting shoulder 168 which serves the function of causing the collet fingers 166 to expand radially outward. The collet expanding piston 162 is normally restrained against movement in the axial direction by means of a shear pin 170 which extends through the expanding piston 162 and into the mandrel 118. Likewise, shear pin 172 extends through the collet 164 and into the mandrel 118. It is important to note that the mandrel 118 does not move after the auxiliary apparatus has been finally positioned within the safety valve. Further it is noted that the ends of the fingers 166 have an enlarged shape so as to extend radially outwardly and are positioned in the vicinity of a shoulder 174 of the lock open piston 106 of the safety valve assembly.

The mandrel 118 has a cylindrically shaped plunger 176 secured thereto at the bottom, which has a diameter which is smaller than the diameter of the opening of the ball valve 112. The plunger 176 includes an extension 178 which is secured thereto and which has a shape on its end 180 such that engagement between the end 180 and the ball valve 112 can be used to rotate the ball valve 112 into the open position. By using an extension instead of having a plunger end which is integral therewith, the extension can be quickly replaced in the event that it is damaged in use.

Having described the structure of the removable auxiliary lock open assembly, the operation thereof will now be described.

Figure 1C:
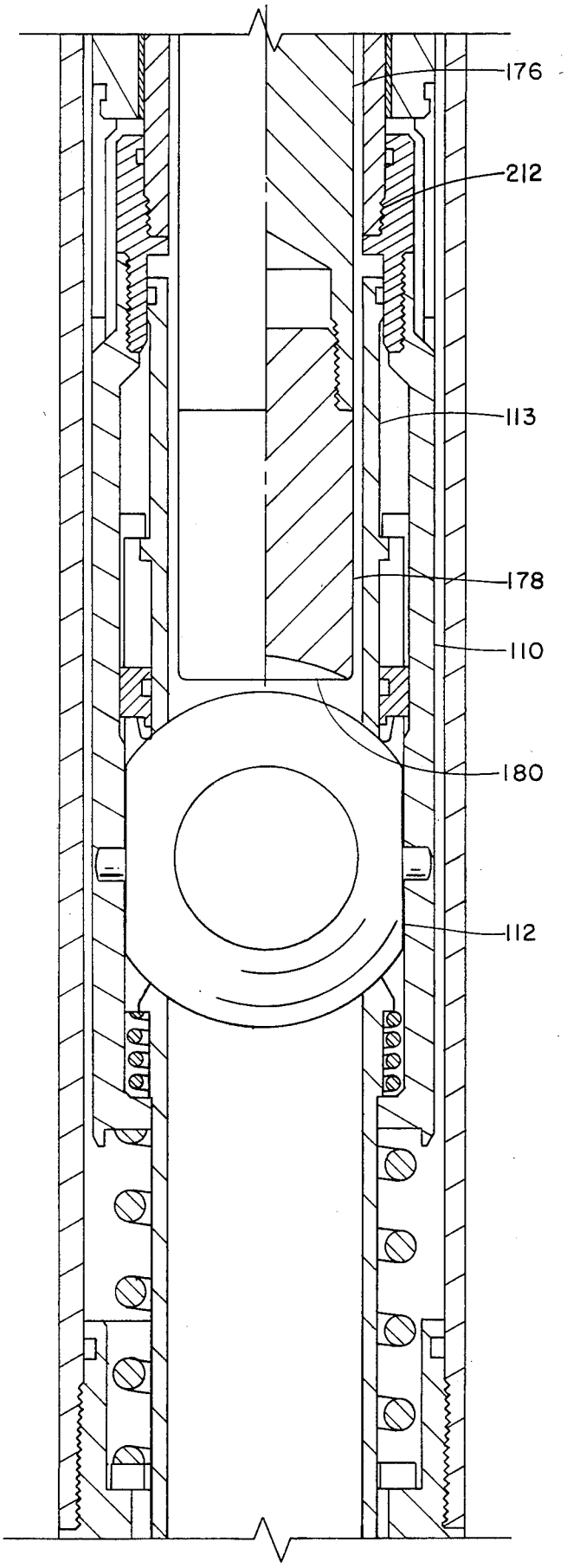

The removable auxiliary lock open assembly is normally secured to a wire line which has a running tool 114 of conventional construction affixed to its lower end. The lock open assembly is inserted into the well when the safety valve 100 is in the closed position. However, it should be noted that the assembly can also be inserted when the safety valve 100 is in a partially open, or even a completely open position. The assembly is inserted into the tube 116 of the well, for permanently locking the safety valve 100 in the open position, until the lower end 180 of the plunger contacts the ball valve as shown in FIGS. 1A, 1B and 1C.

Figure 2B:
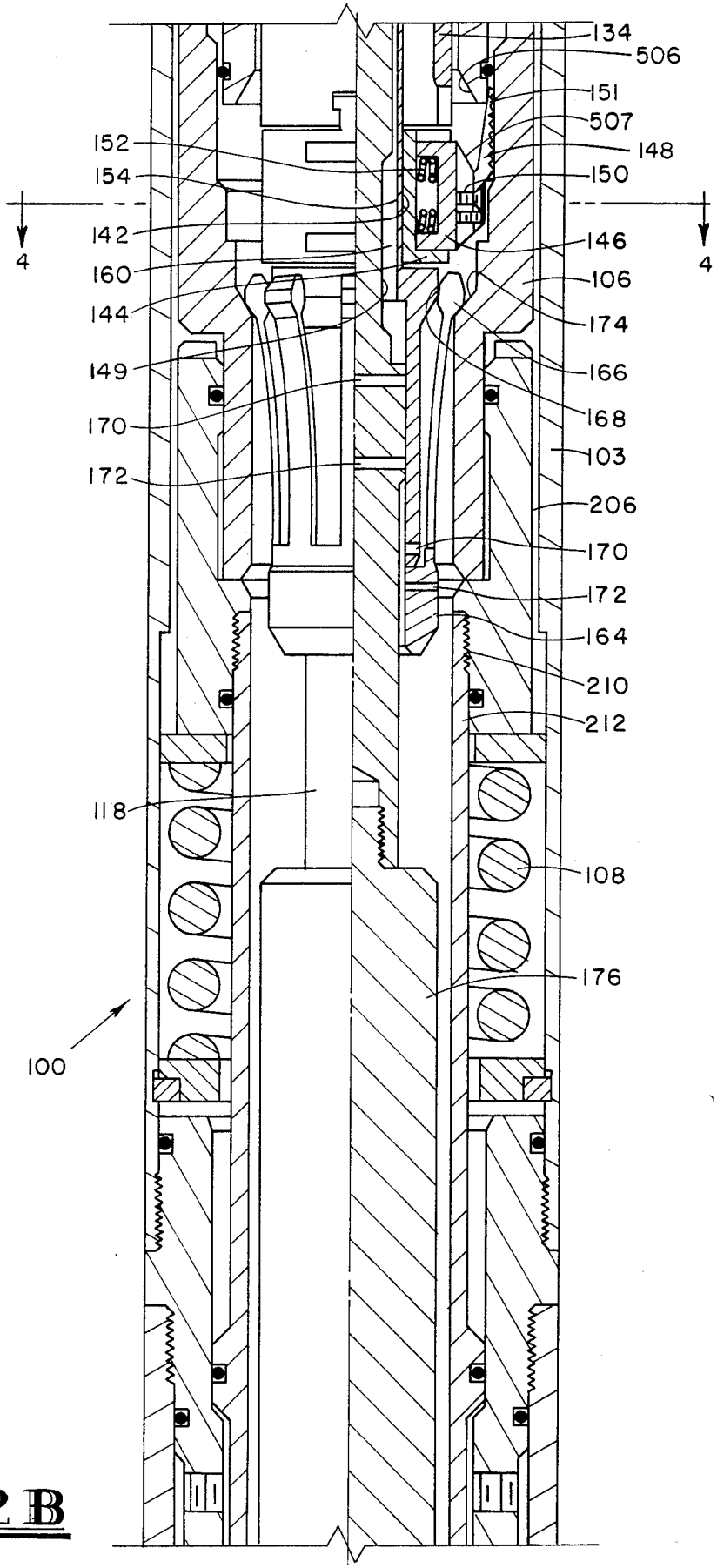

The seals 122, 130 and 132 effectively contact their corresponding surfaces for preventing pressurized fluid leakage along the area adjacent the top sub 102, and pressure is increased through the annular conduit 116 so that the net pressure on the ball valve 112 is equal to zero. Simultaneously, the lower end 180 of the plunger 178 is operated against the ball valve 112 to rotate the ball valve into the open position. This is done by jarring the wire line downward until the upper end of the auxiliary lock open assembly is sealed within the bore of the valve assembly 100 such that O-ring 122 forms a seal between the auxiliary lock open assembly and the inner wall of the safety valve assembly 100 as shown in FIGS. 2A, 2B and 2C.

Figure 2C:
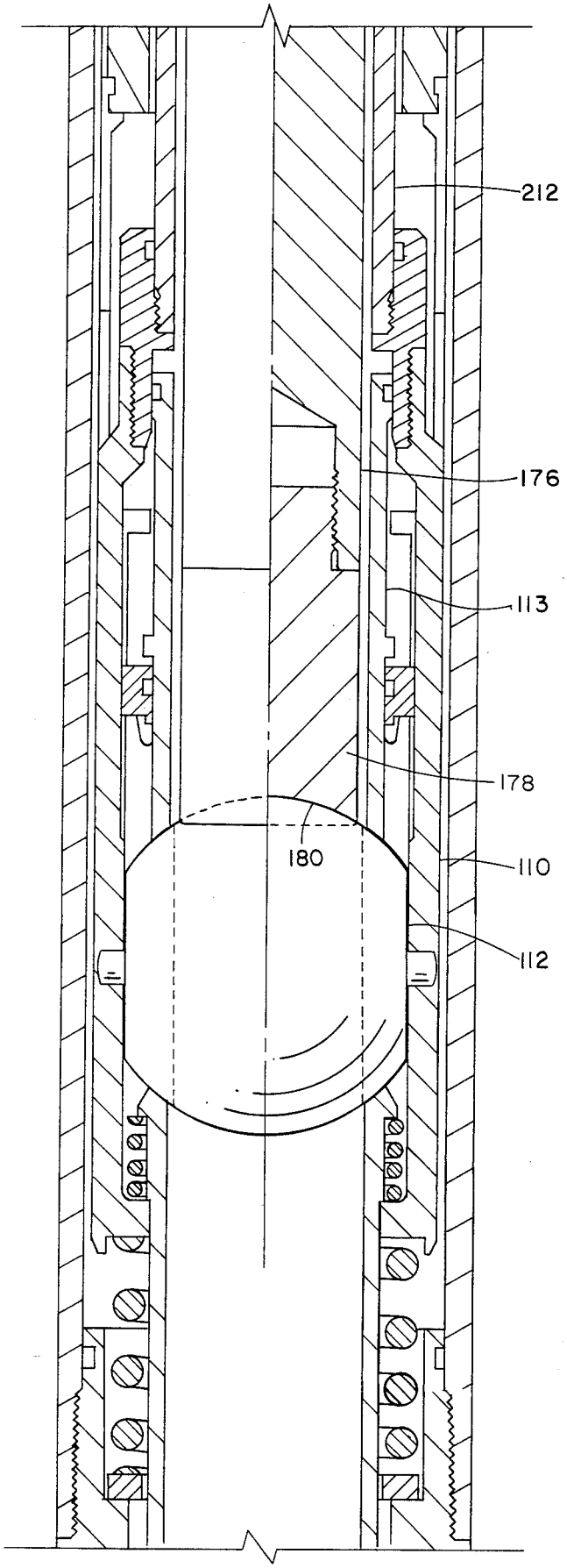

When the auxiliary lock open assembly is jarred into place so that the plunger 176 on the end of the mandrel 118 extends into the open valve 112, as shown in FIG. 2C, the pressure being applied to the conduit 116 from above the auxiliary lock open assembly enters the assembly in the piston chamber 15 and acts on the main piston 128 and on the end of the wedge piston 134. The wedge piston 134 is restrained from movement by the shear pin 163, as shown in FIG. 4, which prevents movement of the wedge carrier slide 142 until the appropriate time.

As pressure is applied, main piston 128 moves downwardly or toward the safety ball valve 112. The force exerted on the main piston 128 is normally confined to the area between the O-rings 130 and 132. The increasing pressure forces the main piston 128 against the top end of the collet expanding piston 162 to force it to move downward. The collet expanding piston 162 subsequently shears the pin 170 and, as the pin 170 shears, the movement of the collet expanding piston 162 brings the shoulder 168 into engagement with the collet fingers 166 to force the collet fingers 166 radially outward so as to engage the shoulder 174 of the lock open piston 106. Thus, the expanded ends 166 of the collet fingers are trapped between the shoulder 168 of the collet expanding piston 162 and the shoulder 174 of the lock open piston 106.

As the pressure continues to increase, the collet expanding piston 162 continues to move downwardly and exerts a force on the collet 164 for shearing the pin 172 which frees the collet from the mandrel 118. The freeing of the collet 164 allows the collet expanding piston 162 to move axially downward along the mandrel 118.

The continuing movement of the main piston 128 downwardly forces the collet expansion piston 162, the wedge piston 134, and the wedge carrier slide 142 which is attached to the collet expansion piston 162 by means of the shear screw 163, to also move downwardly. The ends 166 of the collet fingers which are forced against the shoulder 174 of the lock open piston 106, moves the lock open mechanism of the safety valve toward the ball valve 112, which then locks the ball valve 112, in the open position after sufficient pressure has been applied.

At this time, the wedge carrier slide 142 is moved from a position opposite the larger diameter portion of the mandrel 118, to a position along the mandrel at the lesser diameter portion 149 thereof. This movement allows the ball bearings 154 to drop radially inwardly into the lesser diameter area 149 of the mandrel 118, thereby releasing the wedge carrier cap 146 which is forced radially outwardly by the springs 152 which were previously compressed. The described movement of the ball bearings 154 and the wedge carrier cap 146 is shown in FIGS. 2B, 4 and 5.

The position of the wedge carrying cap 146 is now such that the locking wedge 148 is urged into a recessed portion of the lock open piston 106, as shown in FIG. 2B. It is important to note that at this time the wedge carrier slide 142 is still secured to the piston 162 by shear pin 163.

The movement of the main piston 128, the collet expansion piston 162 and the collet 164 cause the valve opening mechanism to move downwardly against the force of springs 108, thus moving the ball valve locking sleeve 113 against the ball valve 112 and thereby locking the ball valve 112 in the open position.

The locking wedge 148 which locks the valve opening mechanism in a permanently opened position for retaining the ball valve 112 in the open position is positioned in engagement with the body of the lock open piston 106.

As the pressure continues to increase, the pressure affects the wedge piston 134 as fluid enters through the passage 137 into the recess between the O-ring seals 138 and 140 causes the shearing of the screw 163 (FIG. 4). Thus, the wedge piston 134 becomes separated from the collet expanding piston 162 and begins to move fully upward. By so doing, the wedge carrier slide 142 which is attached to the wedge piston 134 also moves upward pulling the wedge carrying cap 146 therewith and placing the wedge 148 into the gap 107 between the lock open piston 106 and the top sub 102. It is clear from FIG. 2B that O-ring seal 105 no longer seals the space in the top sub wherein the lock open piston 106 is received from the remainder of the safety valve.

As the wedge piston 134 continues to move upward as a result of the increase in pressure, the screws 150 shear and the wedge carrier slide 142 eventually abuts the lower portion of the main piston 128.

It should be noted that the top sub 102 includes a surface 506 which corresponds in shape to a surface 507 on the wedge carrying cap 146 to provide a wedging type action for forcing the wedge carrying cap 146 back onto the body of the wedge carrier slide 142 against the urging force of the springs 152 as the wedge piston 134 moves upward.

With the wedge 148 firmly in place and separated from the rest of the auxiliary lock open device, the pressure which has been applied from above to all the parts of the auxiliary device is relieved by bleeding the system and the auxiliary tool, including all the previously described parts except for the locking wedge, are removed from the safety valve 100. As the pressure is relieved, all sliding parts move toward the mandrel so that all the parts can be removed with the wire line and running tool 114 with the exception of the locking wedge 148.

Since the locking wedge 148 is positioned within the gap 107 as previously described, and the wickers 151 are dug into the surface of the safety valve, the wedge 148 is not free to move in either direction and the ball valve lock open sleeve 113 is retained in a lock open position holding the ball valve 112 permanently open. It should be noted that the distance which the locking wedge 148 is jammed into the crack 107 is determined by the amount of pressure that is required to be exerted for shearing the screws 150.

Once all the parts of the auxiliary tool are removed from the safety valve 100, except for the locking wedge 148, the passage or conduit 116 is left fully open for the subsequent installation of a conventional wire line type safety valve.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A removable auxiliary apparatus for use with a flow control device within a conduit in a subterranean well for permanently locking said flow control device in an open position, said flow control device being of the type having a valve head member which is reciprocatingly movable between an open and a closed position and is normally biased to the closed position, drive means connected to said valve head member for causing said valve head member to open and close, and locking sleeve means operatively connected to said drive means for locking said valve head member open when opened by said drive means, said apparatus comprising: a longitudinally extending mandrel having attaching means at the top end thereof for being attached to a running tool for positioning within said flow control device by said running tool; plunger means at the bottom end thereof for engaging and opening said valve head member; a piston member slidably mounted on said mandrel and reciprocatingly movable between a first position and a second position, said piston member having contact means for contacting said drive means when said piston member moves from said first position to said second position and for causing said drive means and locking sleeve means to move into said open position; wedge means releasably attached to said piston member for permanent engagement with said drive means and detachment from said piston member when said valve head member is locked in the open position, retaining means mounted on said piston member for holding said wedge means in a first position disengaged from said drive means when said piston member is in said first position and for allowing said wedge means to engage said drive means when said piston member is in said second position; and release means operatively associated with said piston member for detaching said wedge means from said piston member after said wedge means engages said drive means, whereby said mandrel and said piston member can subsequently be removed from within said flow control device by the running tool.

2. A removable auxiliary apparatus as in claim 1 wherein said attaching means comprises a coupling secured at the top end of the said mandrel and said auxiliary apparatus further comprises an elastomeric seal element carried around said coupling for sealing said auxiliary apparatus from said drive means.

3. A removable auxiliary apparatus as in claim 2 wherein said elastomeric seal element is maintained static during operation of said auxiliary device.

4. A removable auxiliary apparatus as in claim 3 wherein said contact means comprises an expandable collet slidably mounted on the said mandrel below said piston member and a collet expanding piston slidably mounted on said mandrel between said collet and said piston member for being acted on by said piston member for causing said collet to expand for engaging said drive means for opening said valve head member.

5. A removable auxiliary apparatus as in claim 4 wherein said apparatus is activated by applying increasing fluid pressure thereto, said expandable collet and collet expanding piston being secured to said mandrel by means of respective first and second shear pins, and said expandable collet and collet expanding piston being held immobile against said mandrel until said fluid pressure exceeds a specified minimum.

6. A removable auxiliary apparatus as in claim 1 wherein said wedge means comprises a wedge-shaped body having wickers on the outer surface thereof which faces the drive means.

7. A removable auxiliary apparatus as in claim 1 further comprising a wedging piston member carried on said first mentioned member for forcibly urging said wedge means against said drive means into said position engaging said drive means for permanently locking said valve head member in said open position.

8. A removable auxiliary apparatus as in claim 1 wherein said retaining means comprises a wedge carrier slide slidingly mounted on said mandrel below said piston member for being moved to said second position by said piston member, an outwardly spring biased wedge carrier mounted on said wedge carrier slide and having a wedge thereon, said wedge carrier being retained inwardly against the spring bias when said piston member is in said first position and released for causing said wedge to engage the drive means when said piston member and wedge carrier are in said second position.

9. A removable auxiliary apparatus as in claim 1 wherein said wedge means is releasably attached to said piston member by shearable pins which shear when said wedge means is in place for permanently locking said flow control device open and a specified minimum force is exerted on said shearable pins.

10. An auxiliary apparatus for use with a flow control mechanism within a conduit in an open position, said flow control mechanism including a valve element movable between an open and a closed position relative to said conduit, comprising: a work string carried mandrel, a locking element carried by said mandrel and radially shiftable by movement of said mandrel between a contracted run-in position and a radially expanded position engaging and locking said flow control mechanism in its said open position; and means for releasing said locking element from said mandrel when said locking element assumes said radially expanded position, thereby permitting removal of said mandrel from the well conduit with said locking element remaining in the well conduit.

11. The apparatus of claim 10 wherein said flow control mechanism defines in its open position an axial flow passage substantially equal in area to the conduit bore; said locking element being disposed exteriorly of said axial flow passage in its said radially expanded position.

12. The apparatus of claim 10 further comprising means on the lower portions of said mandrel engagable with said flow control mechanism if said mechanism is not in a fully opened position to effect movement of said flow control device to said fully open position by the downward insertion movement of said mandrel.

13. The apparatus of claim 10 wherein said flow control mechanism includes a downwardly shiftable sleeve in said conduit for moving said valve element to its said open position, and said locking element comprises a wedge forcibly engagable between said sleeve and said conduit wall to prevent upward movement of said sleeve, thereby permanently locking said valve element in said open position.

14. The method of permanently locking open a safety valve assemblage disposed in a subterranean well conduit and having a valve element shiftable between a position closing the conduit to fluid flow and a position opening substantially the entire conduit bore to fluid flow comprising the steps of:

1. mounting a radially expandible locking element on a mandrel and retaining same in a radially retractable position freely insertable in the conduit bore;
2. running the mandrel into the conduit bore to position the locking element adjacent the safety valve assemblage;
3. radially expanding the locking element to engage the safety valve mechanism to lock the valve element in said open position; and
4. removing the mandrel from the conduit and leaving the locking element in said radially expanded position.

15. The method of claim 14 wherein said locking element is radially expanded to lie outside the conduit bore.

16. A method of permanently locking open a flow control device permanently mounted in a conduit in a subterranean well of the type having a valve head member which is reciprocatingly movable between open and closed positions and is normally biased in the closed position, comprising the successive steps of: lowering down the conduit into the flow control device a removable auxiliary locking apparatus having detachable locking means attached thereto for locking the flow control device in its valve head member open position, positioning said detachable locking means adjacent the flow control device with the valve head member in the open position; bringing said locking means into permanent engagement with said flow control device thereby preventing movement of said valve head member from the open position, detaching said locking means from said auxiliary locking apparatus; and removing said auxiliary locking apparatus from said conduit, whereby said detachable locking means is inserted into the well to lock the valve head member in the open position and said locking means is left in the well after removal of said auxiliary locking apparatus.

17. A method of permanently locking open a flow control device permanently mounted in a conduit in a subterranean well of the type having a valve head member which is reciprocatingly movable between open and closed positions and is normally biased in the closed position, drive means connected to said valve head member for causing said valve head member to open and close, comprising the successive steps of: lowering down the conduit into the flow control device a removable auxiliary locking apparatus having detachable locking means attached thereto for locking the drive means in its valve head member open position, and having support means for engaging the flow control device; positioning said detachable locking means adjacent the drive means with the drive means in the valve head member open position; bringing said locking means into permanent engagement with said drive means thereby preventing movement of said drive means out of its valve head member open position; detaching said locking means from said auxiliary locking apparatus; and removing said auxiliary locking apparatus from said conduit, whereby said detachable locking means is inserted into the well to lock the drive means in the valve head member open position and said locking means is left in the well after removal of said auxiliary locking apparatus.

18. A method of permanently locking open a flow control device permanently mounted in a conduit in a subterranean well of the type having a valve head member which is reciprocatingly movable between open and closed positions and is normally biased in the closed position, drive means connected to said valve head member for causing said valve head member to open and close, comprising the successive steps of: lowering down the conduit into the flow control device a support means having a moving means slidably mounted thereon for engaging and moving the drive means, and detachable locking means attached to said moving means for locking the drive means in its valve head member open position; moving said moving means relative to said support means while the latter is in fixed position relative to the flow control device, so as to engage said drive means and move said drive means to its valve head member open position; bringing said locking means into permanent engagement with said drive means thereby preventing movement of said drive means out of its valve head member open position; detaching said locking means from said moving means; and removing said support means and moving means from said flow control device and from said conduit.

* * * * *